US005996995A

United States Patent [19]

Kim et al.

[11] Patent Number: 5,996,995

[45] Date of Patent: Dec. 7, 1999

[54] DEVICE FOR SWITCHING PAPER PASSAGE IN MULTI-FUNCTIONAL IMAGE PRODUCING APPARATUS

[75] Inventors: Seong-Woo Kim; Yong-Geun Kim, both of Suwon, Rep. of Korea

[73] Assignee: SamSung Electronics Co., Ltd., Kyungki-do, Rep. of Korea

[21] Appl. No.: 08/799,992

[22] Filed: Feb. 13, 1997

[30] Foreign Application Priority Data

Feb. 13, 1996 [KR] Rep. of Korea ..... 96/3417

[51] Int. Cl.[6] ..... B65H 39/10

[52] U.S. Cl. ..... 271/303; 271/9.13; 271/184; 399/363

[58] Field of Search ..... 271/303, 3.19, 271/4.01, 4.1, 3.15, 4.02, 9.13, 9.01, 184, 185, 304, 302, 225; 399/361, 363

[56] References Cited

U.S. PATENT DOCUMENTS

| | | | |
|---|---|---|---|
| 2,076,700 | 4/1937 | Bryce . | |
| 3,519,801 | 7/1970 | Nielsen et al. | 271/9.13 X |
| 4,277,061 | 7/1981 | Nagel et al. | 271/303 X |
| 4,518,161 | 5/1985 | Nakamura . | |
| 5,132,742 | 7/1992 | Goto | 271/9.13 X |
| 5,184,734 | 2/1993 | Yamaguchi | 271/303 X |
| 5,386,913 | 2/1995 | Taylor | 271/303 X |
| 5,394,992 | 3/1995 | Winkler . | |

FOREIGN PATENT DOCUMENTS

| | | | |
|---|---|---|---|
| 0057467 | 3/1988 | Japan | 271/303 |
| 0013566 | 1/1990 | Japan | 271/303 |
| 404064567 | 2/1992 | Japan | 271/303 |
| 404094367 | 3/1992 | Japan | 271/303 |
| 40427058 | 9/1992 | Japan | 271/303 |

*Primary Examiner*—Christopher P. Ellis
*Assistant Examiner*—Steven B. McAllister
*Attorney, Agent, or Firm*—Robert E. Bushnell, Esq.

[57] ABSTRACT

An electromagnetically operated sheet diverter for an image forming apparatus. The sheet diverter diverts a sheet from a common path to one of two possible paths upon discharge from the image forming apparatus. The sheet diverter is small and compact, making the sheet diverter suitable for desktop image forming devices. A main controller operates the sheet diverter to divert sheets depending on the tray of origin. The sheet diverter has a holding bracket. An electromagnet is mounted to the holding bracket. A spring-biased paper diverting member is selectively attracted by and brought into contact with the electromagnet only when the magnet is activated. A longitudinal shaft is tightly held by the paper diverting member and is selectively rotated along with the paper diverting member. The longitudinal shaft has a plurality of fitting grooves, which are spaced out at regular intervals and have a D-shaped cutting configuration. A passage switching member is fixed to each fitting groove of the longitudinal shaft and is selectively rotated by the magnet thereby switching the paper passage between the document passage and the copy paper passage.

21 Claims, 3 Drawing Sheets

DEVICE FOR SWITCHING PAPER PASSAGE IN MULTI-FUNCTIONAL IMAGE PRODUCING APPARATUS

CLAIM OF PRIORITY

This application makes reference to, incorporates the same herein, and claims all benefits accruing under 35 U.S.C. §119 arising from an application for Device For Switching Paper Passage in Multi-Functional Image Producing Apparatus earlier filed in the Korean Industrial Property Office on Feb. 13, 1996 and there duly assigned Ser. No. 3417/1996.

BACKGROUND OF THE INVENTION

1. Field of the Invention

The present invention relates, in general, to a device for controlling the paper passage in an image producing apparatus and, more particularly, to a device for switching the paper passage between an original document passage and a copy paper passage in a multi-functional image producing apparatus selectively used as a facsimile, a copying machine and a printer.

2. Description of the Prior Art

The use of electromagnetic sheet diverters is not new in the art. For example, U.S. Pat. No. 4,518,161 for a Sheet Sorting Apparatus to Nakamura discloses an electromagnetically operated sheet sorting apparatus. Sheets originate from a common path and are diverted by the magnetically controlled sheet diverter to one of the two paths.

U.S. Pat. No. 2,076,700 for a Sorting Machine to Bryce discloses an electromagnetic sheet diverter controlled by a solenoid. Sheet diverters and are used to discharge sheets of paper from an image forming apparatus. A magnet serves to trigger a sheet deflector.

Finally, U.S. Pat. No. 5,394,992 for a Document Sorter to Winkler discloses a document sorter which is magnetically operated. Once again, a magnet triggers the sheet diverter which determines which direction and path a sheet will be discharged from the image forming apparatus.

What is needed is a compact sheet diverter designed to operate in a compact desktop image forming apparatus. The compact sheet diverter has a compact electromagnet and a compact rotating member which serves to divert a piece of paper between one of two paths. The sheet diverter is operated automatically by a control unit so that original documents are diverted automatically down one path and copy paper is automatically diverted down another path.

SUMMARY OF THE INVENTION

It is, therefore, an object to provide a sheet diverter for an image forming apparatus that can select between one of two paths in which a sheet of recording medium is to be discharged from the machine.

It is also an object to provide a compact electromagnetic sheet diverter that can be used on desktop image forming equipment.

In order to accomplish the above object, the present invention provides a device for switching the path of discharge so that originals fed into one input tray emerge at one output tray, and recording sheets that originate from a separate input tray are discharged onto a separate tray. The sheet diverter is made up of a holding bracket fixedly arranged on a position just after the distributing roller. An electromagnet is mounted to the holding bracket. A paper diverting member is rotatably mounted to a housing of the apparatus by a hinge shaft and is biased by a tension coil spring. The paper diverting member is selectively attracted by and brought into contact with the electromagnet only when the magnet is activated. A longitudinal shaft is tightly held by the paper diverting member and is selectively rotated along with the paper diverting member when the magnet is activated. The longitudinal shaft has a plurality of fitting grooves, which are spaced out at regular intervals and have a D-shaped cutting configuration. A plurality of passage switching members are fixed to the respective fitting grooves of the longitudinal shaft and are selectively rotated along with the longitudinal shaft, thus switching the paper passage between the original document passage and the copy paper passage.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DESCRIPTION OF THE INVENTION

Figure 1:
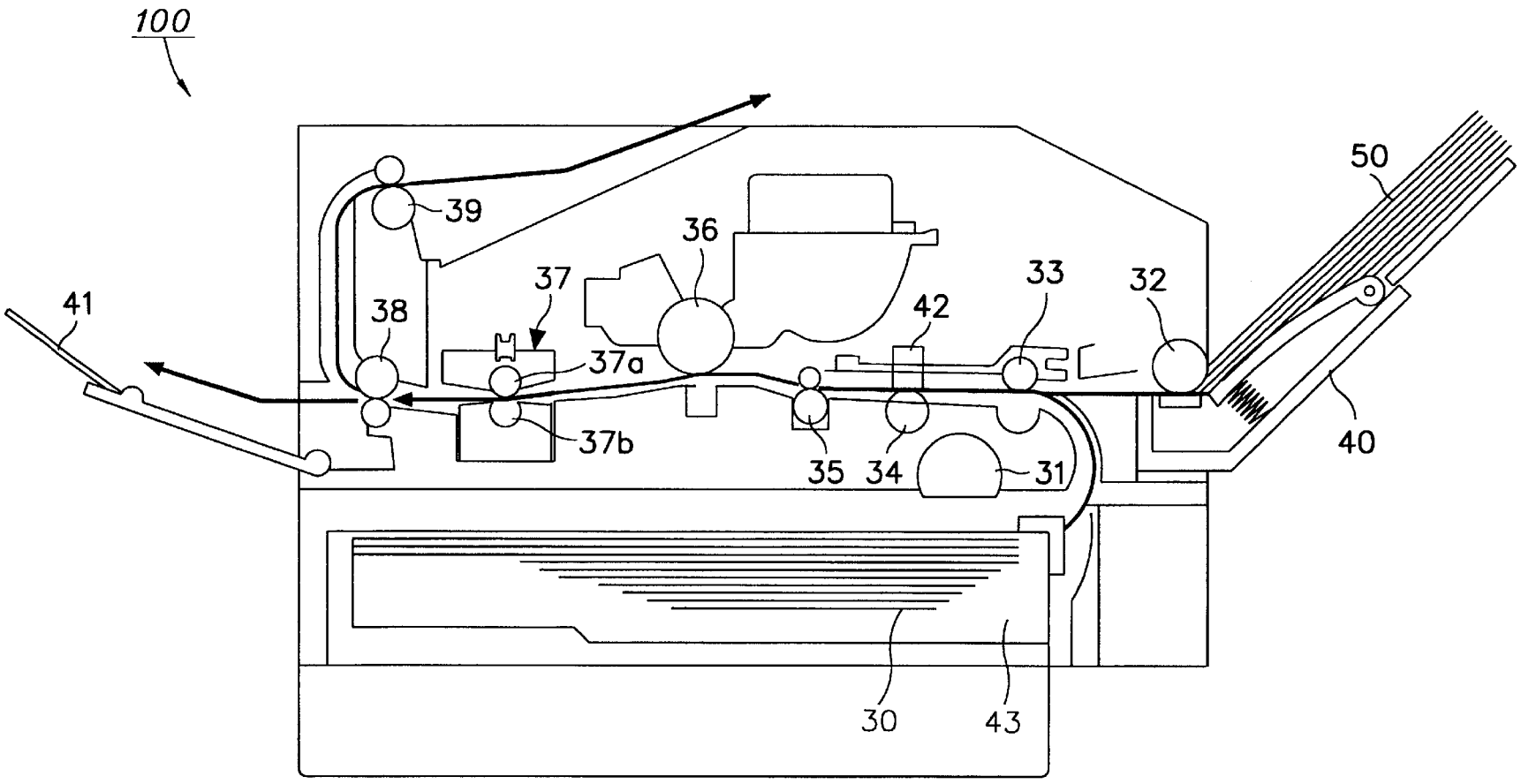
FIG. 1 is a view showing the construction of a facsimile which is an example of an image producing apparatus provided with a paper passage switching device according to the present invention.

FIG. 1 is a view of a facsimile which is an example of an image producing apparatus provided with a paper passage switching device according to the present invention. As shown in FIG. 1, the facsimile 100 has an image transmitting part which is integrated with the image receiving part. In the image transmitting part, a document feed tray 40 is mounted to one side (the right-hand side in the drawing) of the facsimile 100 and holds original documents 50 thereon. During image transmission, the frictional force between each document 50 and a motor-driven document feed roller 32 is larger than either the frictional force between the documents 50 or the frictional force between each document 50 and the rubber pad of the document feed roller 32. Therefore, each document 50 passes by the document feed roller 32 and return roller 33 and in turn is fed to a contact image sensor 42. The contact image sensor 42 reads and transmits the image data written on the document 50.

In the above state, a scanning white roller 34, which is arranged under the contact image sensor 42, checks the reference data prior to reading the data of the document 50 and frictionally feeds the document 50 to the roller 35 while reading the data of the document 50. Prior to feeding the document 50, an LED of the contact image sensor 42 emits light and senses the return light, which is reflected by the white roller 34, by an optical sensor thereby checking the reference data. Thereafter, the data is coded and compressed prior to being transmitted through a telephone line. The document 50 from the roller 35 passes by a photosensitive drum 36 and is fed to the fixing part or the nip between the heating roller 37*a* and the pressure roller 37*b*, and is fed to a distributing roller 38. The document 50 is, thereafter, fed to the document discharge roller 39 thus finishing the image transmitting operation.

In the above image transmitting operation, the photosensitive drum 36, heating roller 37*a* and pressure roller 37*b* do not perform their intrinsic operational functions, but are only used as document feeding rollers.

In operation of the image receiving part integrated with the image transmitting part, the outer surface of the photosensitive drum 36 is uniformly charged with electricity due to corona discharge of a charged body (not shown) installed in the facsimile 100. The photosensitive drum 36 in the above state is rotated, so that the charged surface of the drum 36 is exposed to the electric image signals from a light exposing unit (not shown) thereby forming an electro-static latent image on the charged surface of the drum 36. The electro-static latent image of the photosensitive drum 36 in tum is developed by toner thus forming a visible image on the drum 36 while the rotated drum 36 passes by the developing unit (not shown), which is arranged at a position in the vicinity of the photosensitive drum 36. A sheet of copy paper 30, which is contained in the paper cassette 43, is fed by the motor-driven copy paper feed roller 31. The visible image of the photosensitive drum 36 is thus transcribed onto the copy paper 30 due to the high voltage operation of a transcriber (not shown) The copy paper 30 is, thereafter, fed to the nip between the heating roller 37*a* and the pressure roller 37*b*, so that heat and pressure are applied to the paper 30 thereby fixing the image on the paper 30. The copy paper 30 with the image in turn is fed to the distributing roller 38 and is discharged onto a copy paper tray 41, thus finishing the image receiving operation. In the above image receiving operation, toner and latent image remain on the outer surface of the photosensitive drum 36 after the visible image is transcribed onto the copy paper 30. The toner remaining on the drum 36 is removed by a cleaner (not shown), while the latent image remaining on the drum 36 is removed by a latent image erasing lamp (not shown).

The facsimile 100 also has a copying part. In the facsimile 100, the document feed tray 40, which is mounted to the rear portion of the facsimile 100, holds documents 50. In operation of the copying part, the frictional force generated between each document 50 and the motor-driven document feed roller 32 is larger than either the frictional force between the documents 50 or the frictional force between each document 50 and the rubber pad of the document feed roller 32. Therefore, each document 50 passes by the document feed roller 32 and return roller 33 and is fed to the contact image sensor 42. The contact image sensor 42 reads and transmits the image data written on the document 50.

In the above state, the scanning white roller 34, which is arranged under the contact image sensor 42, checks the reference data prior to reading the data of the document 50 and frictionally feeds the document 50 to the roller 35 while reading the data of the document 50. Prior to feeding the document 50, the LED of the contact image sensor 42 emits light and senses the return light, which is reflected by the white roller 34, by the optical sensor thereby checking the reference data. Thereafter, the document 50 is fed to the nip between the heating roller 37*a* and the pressure roller 37*b* by way of the photosensitive drum 36 and in turn is fed to the distributing roller 38. In the above operation, the photosensitive drum 36, heating roller 37*a* and pressure roller 37*b* do not perform their intrinsic operational functions, but are only used as document feeding rollers. At the same time, the outer surface of the photosensitive drum 36 is uniformly charged with electricity due to corona discharge of the charged body installed in the facsimile 100. The photosensitive drum 36 in the above state is rotated, so that the charged surface of the drum 36 is exposed to the electric image signals from the light exposing unit thereby forming an electro-static latent image on the charged surface of the drum 36. The electro-static latent image of the photosensitive drum 36 in tum is developed by toner thus forming a visible image on the drum 36 while the rotated drum 36 passes by the developing unit, which is arranged at the position in the vicinity of the photosensitive drum 36. Thereafter, the copy paper 30, which is contained in the paper cassette 43, is fed by the motor-driven paper feed roller 31. The visible image of the photosensitive drum 36 is thus transcribed onto the copy paper 30 due to the high voltage operation of the transcriber. The copy paper 30 is, thereafter, fed to the nip between the heating roller 37*a* and the pressure roller 37*b*, so that heat and pressure are applied to the paper 30 thereby fixing the image on the paper 30. The copy paper 30 with the image in turn is fed to the distributing roller 38 and is discharged onto the copy paper tray 41, thus finishing the copying operation. In the above copying operation, toner and latent image remain on the outer surface of the photosensitive drum 36 after the visible image is transcribed onto the copy paper 30. The toner remaining on the drum 36 is removed by the cleaner, while the latent image remaining on the drum 36 is removed by the latent image erasing lamp.

In the above facsimile 100 having the image transmitting part integrated with the image receiving pat the passage of the documents 50 of the document feed tray 40 and the passage of the copy papers 30 of the paper cassette 43 are partially identified with each other. That is, each document 50 and each copy paper 30 commonly passes through the passage, which includes the return roller 33, contact image sensor 42, scanning white roller 34, roller 35, photosensitive drum 36, heating roller 37*a*, pressure roller 37*b* and distributing roller 38. However, the documents 50 from the distributing roller 38 are fed to the document discharge roller 39, while the copy papers 30 from the roller 38 are fed to the copy paper tray 41. Therefore, in accordance with a selected operation of the facsimile 100, the paper passage inside the facsimile 100 must be appropriately switched between the document passage and the copy paper passage at a position just after the distributing roller 38. In order to achieve the above object, a paper passage switching device of this invention is installed on a position just after the distributing roller 38. At this position, the document passage extending to the roller 39 is branched from the copy paper passage extending to the tray 41.

Figure 2:
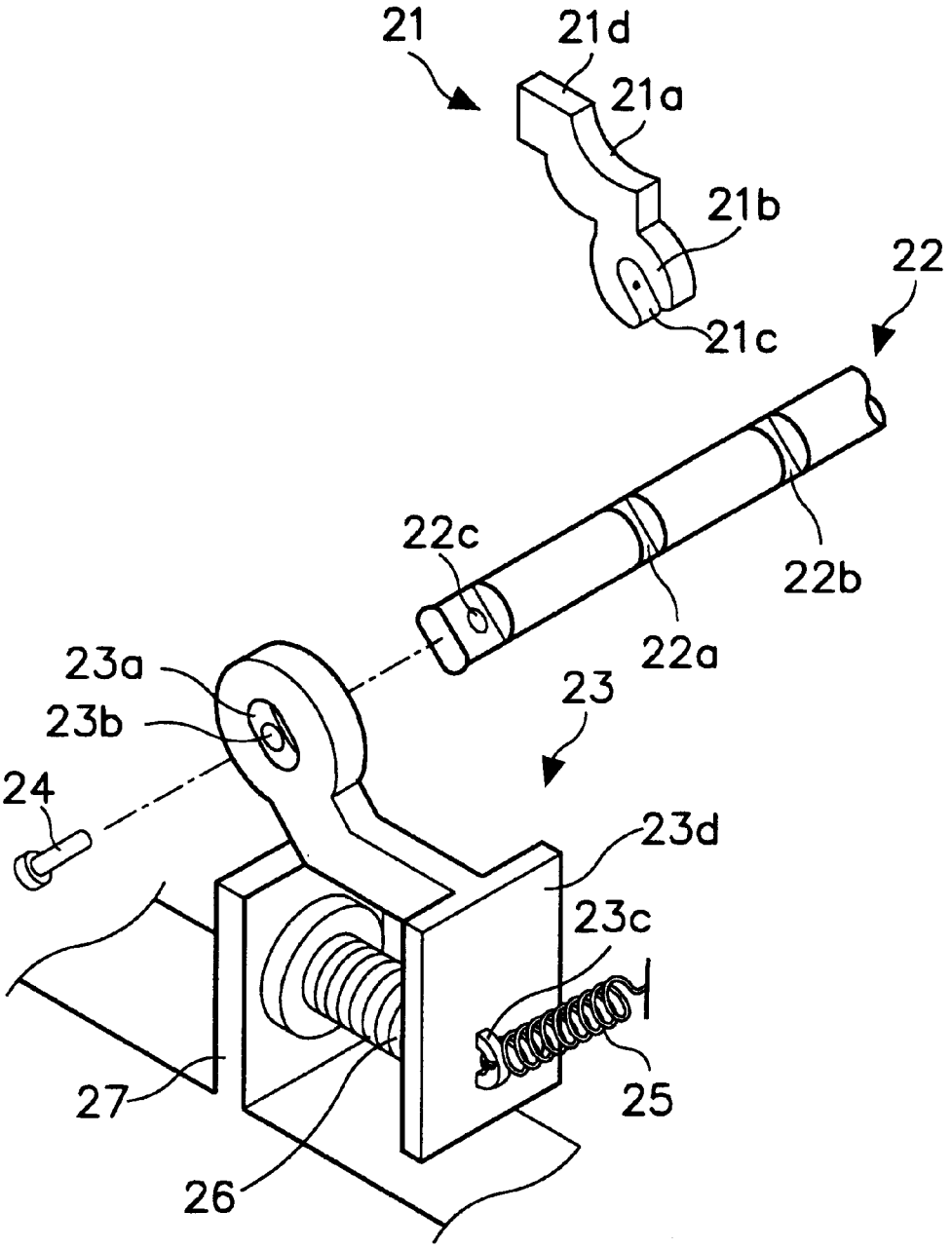
FIG. 2 is a partially-exploded perspective view showing the construction of a paper passage switching device in accordance with the preferred embodiment of the present invention.

FIG. 2 is a partially-exploded perspective view showing the construction of the paper passage switching device in accordance with the preferred embodiment of the present invention. The copy paper tray 41 is installed on the other side (the left-hand side in the drawing) of the facsimile 100. The paper passage switching device includes a holding bracket 27 which is stably arranged on the paper passage at a position just after the distributing roller 38. An electromagnet 26 is mounted to the holding bracket 27. A paper diverting member 23 is rotatably mounted to the housing of the facsimile 100 by a hinge shaft and is biased by a tension coil spring 25, so that the paper diverting member 23 is selectively attracted by and brought into contact with the electromagnet 26 when the magnet 26 is turned on and activated. Meanwhile, the magnet 26 releases the paper diverting member 23 when the magnet 26 is turned off. Tightly fitted into the other end of the paper diverting member 23 is a longitudinal shaft 22 which is provided with a plurality of fitting grooves 22*a* and 22*b*. The above grooves 22*a* and 22*b* are spaced apart from each other at regular intervals and have a D-shaped cutting configuration.

One end of the paper diverting member 23 has a drive plate 23*d*, while the other end of the member 23 has both a fitting hole 23*a* and a pin hole 23*b* in order to hold the shaft 22. The drive plate 23*d* has a spring hook 23*c* which connects one end of the tension coil spring 25 to the drive plate 23*d*.

When fitting the shaft 22 into the paper diverting member 23, one end of the shaft 22 is fitted into the fitting hole 23*a* of the paper diverting member 23. Thereafter, a pin 24 is inserted into the pin hole 23*b* of the paper diverting member 23 and into a pin hole 22*c* of the shaft 22 thereby fixing the shaft 22 to the paper diverting member 23.

A plurality of paper passage switching members 21 are fixed to the fitting grooves 22*a* and 22*b* of the shaft 22. One end of each member 21 has a flat surface 21*d*. A guide surface 21*a* is formed on the middle portion of each member 21, while a fixing part 21*b* is formed on the other end of each member 21. A fitting slit 21*c*, which has a configuration corresponding to the cross-section of each fitting groove 22*a*, 22*b* of the shaft 22, is formed on the tip of the fixing part 21*b*.

The paper passage switching members 21 are tightly fitted over the fitting grooves 22*a* and 22*b* of the shaft 22. The paper diverting angle of the shaft 22 is predetermined by the paper diverting motion of the paper diverting member 23. The paper diverting member 23 is rotatable about the hinge shaft in opposite directions by the attraction force of the electromagnet 26 and the restoring force of the tension coil spring 25.

The above facsimile 100 has the document feed tray 40 on its paper outlet side. In operation of the image transmitting part of the facsimile 100, the frictional force between each document 50 and the motor-driven document feed roller 32 is larger than either the frictional force between the documents 50 or the frictional force between each document 50 and the rubber pad of the document feed roller 32. Therefore, each document 50 is fed to the contact image sensor 42 by both the document feed roller 32 and return roller 33. The contact image sensor 42 reads and transmits the image data written on the document 50.

In the above state, the scanning white roller 34, which is arranged under the contact image sensor 42, checks the reference data prior to reading the data of the document 50 and frictionally feeds the document 50 to the roller 35 while reading the data of the document 50. Prior to feeding the document 50, the LED of the contact image sensor 42 emits light and senses the return light, which is reflected by the white roller 34, by the optical sensor thereby checking the reference data. Thereafter, the data is coded and compressed prior to being transmitted through a telephone line. The document 50 is fed to the nip between the heating roller 37*a* and the pressure roller 37*b* by way of the photosensitive drum 36 and in turn is fed to the distributing roller 38. The document 50 is, thereafter, fed to the document discharge roller 39 thus finishing the image transmitting operation.

Figure 3A:
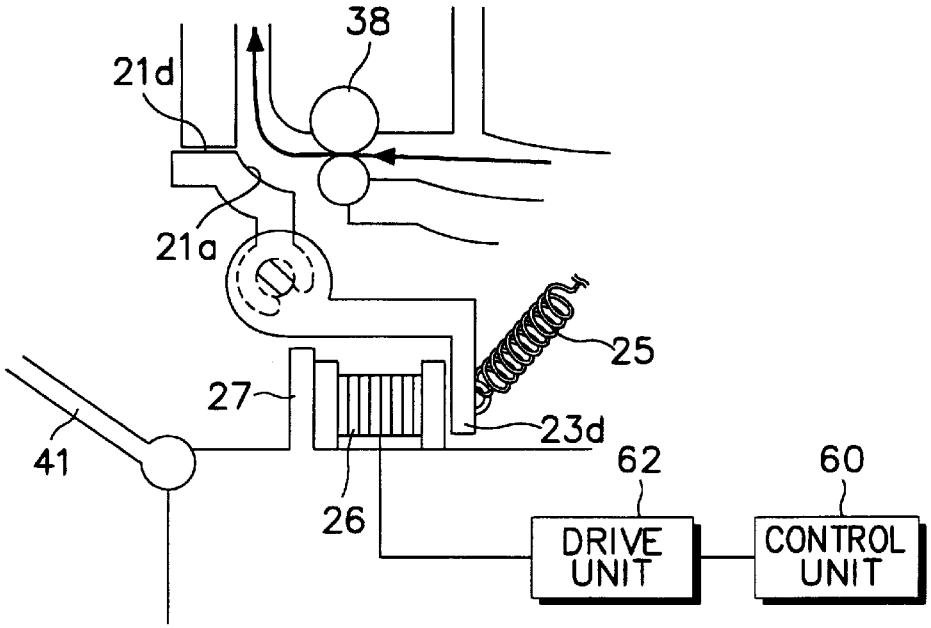
FIGS. 3A and 3B are side views showing the operation of the paper passage switching device of FIG. 2.

In the above image transmitting operation, the photosensitive drum 36, heating roller 37*a* and pressure roller 37*b* do not perform their intrinsic operational functions, but are only used as document feeding rollers. In the above operation, electric power is applied to the electromagnet 26 of the paper passage switching device under the control of both the control unit 60 (FIG. 3A) and the drive unit 62 electrically connected to the magnet 26, thus activating the magnet 26. The drive plate 23*d* of the paper diverting member 23 is thus attracted by and brought into contact with the magnet 26 thereby being maintained in its vertical position as shown in FIG. 3A. Therefore, each document 50 from the distributing rollers 38 is fed to the document discharge rollers 39 under the guide of the guide surface 21*a* of the paper passage switching member 21.

In the printing operation of the facsimile 100, the outer surface of the photosensitive drum 36 is uniformly charged with electricity due to corona discharge of the charged body installed in the facsimile 100. The photosensitive drum 36 in the above state is rotated, so that the charged surface of the drum 36 is exposed to the electric image signals from the light exposing unit thereby forming an electrostatic latent image on the charged surface of the drum 36. The electrostatic latent image of the photosensitive drum 36 in turn is developed by toner thus forming a visible image on the drum 36 while the rotated drum 36 passes by the developing unit, which is arranged at the position in the vicinity of the photosensitive drum 36. In the above state, the copy paper 30, which is contained in the paper cassette 43, is fed by the motor-driven paper feed roller 31. The visible image of the photosensitive drum 36 is thus transcribed onto the copy paper 30 due to the high voltage operation of the transcriber.

Figure 3B:
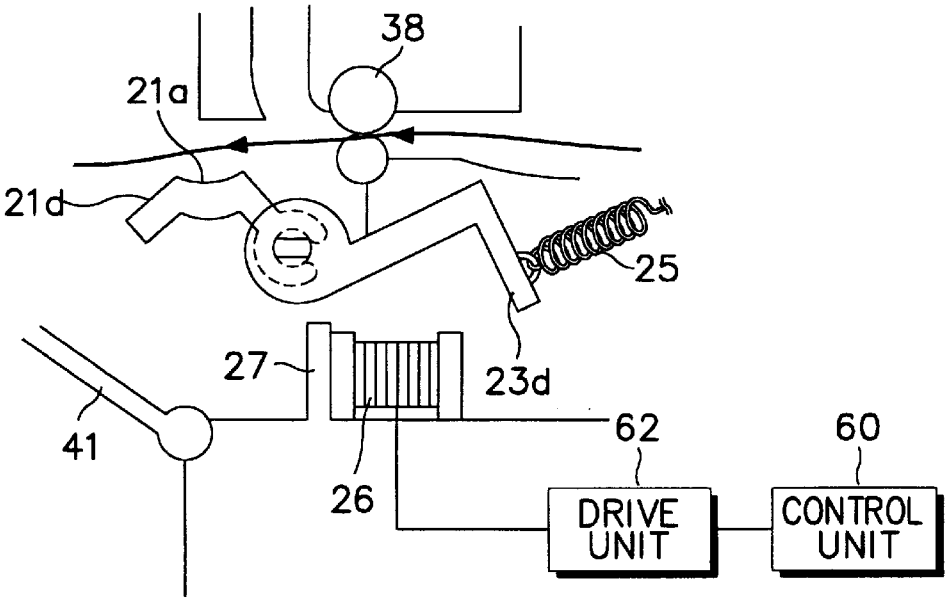

The copy paper 30 is, thereafter, fed to the nip between the heating roller 37*a* and the pressure roller 37*b*, so that heat and pressure are applied to the paper 30 thereby fixing the image on the paper 30. In the above state, the electromagnet 26 of the paper passage switching device is turned off, so that the magnet 26 does not attract the drive plate 23*d* of the paper diverting member 23 thereby releasing the drive plate 23*d*. The paper diverting member 23 in the above state is pulled by the restoring form of the tension coil spring 25 thereby being rotated counterclockwise as shown in FIG. 3B. Therefore, the paper passage toward the copy paper tray 41 is opened thereby guiding the copy paper 30 to the copy paper tray 41. In the above facsimile printing operation, toner and latent image remain on the outer surface of the photosensitive drum 36 after the visible image is transcribed onto the copy paper 30. The toner remaining on the drum 36 is removed by the cleaner, while the latent image remaining on the drum 36 is removed by the latent image erasing lamp.

As described above, the present invention provides a device for switching the paper passage between an original document passage and a copy paper passage in a multi-functional image producing apparatus. The paper passage switching device of this invention effectively and automatically switches the paper passage in accordance with a selected operation of the multi-functional image producing apparatus, thus being convenient to users.

Although the preferred embodiment of the present invention has been disclosed for illustrative purposes, those skilled in the art will appreciate that various modifications, additions and substitutions are possible, without departing from the scope and spirit of the invention as disclosed in the accompanying claims. That is, the paper passage switching device according to the preferred embodiment is installed on a position in vicinity to the paper outlet side of the apparatus and uses a tension coil spring and an electromagnet as a means for generating the power which is used for moving the passage switching member. However, it should be understood that the device may be effectively installed on another position where the paper passage is branched. In addition, the device of this invention may use two electromagnets which are alternately activated when it is necessary to switch the paper passage. That is, any type of means, which can generate the power for moving the passage switching member, can be used in place of the above-mentioned tension coil spring and electromagnet without affecting the functioning of this invention.

What is claimed is:

1. An electromagnetic sheet diverter for an image forming apparatus for switching a paper passage between a first passage and a second passage, comprising:

a holding bracket mounted on said image forming apparatus;

an electromagnet mounted to said holding bracket;

a paper diverting member rotatably mounted to said apparatus and having a drive plate disposed in proximity to said electromagnet, said drive plate being biased to assume a first position separated from said electromagnet, said paper diverting member being selectively attracted by the electromagnet when said electromagnet is electrically activated, said paper diverting member being rotated when attracted by said electromagnet so as to move said drive plate into a second position in contact with said electromagnet;

a longitudinal shaft connected to said paper diverting member and rotated along with said paper diverting member when said electromagnet is activated, said longitudinal shaft having a plurality of fitting grooves formed therein and spaced out at intervals along a length of said longitudinal shaft; and a plurality of passage switching members each having a slot formed in an end of said switching member with a configuration corresponding to a cross-sectional shape of said one of said grooves engaging a corresponding one of said grooves of said longitudinal shaft, grooves of the longitudinal shaft and rotated along with said longitudinal shaft so as to switch the paper passage between said first passage and said second passage.

2. The diverter according to claim 1, wherein said drive plate is connected to said tension coil spring at one end, and has a fitting hole and a pin hole formed therein at another end thereof for holding said longitudinal shaft.

3. The diverter according to claim 1, wherein each of said passage switching members comprises:

a flat surface formed on another end of said switching member; and a guide surface formed on a middle portion of said switching member.

4. The diverter according to claim 1, wherein said holding bracket comprises a flat surface to which one end of said electromagnet is attached, said drive plate comprising a flat plate disposed at another end of said electromagnet and disposed parallel to said flat surface of said holding bracket when said electromagnet is activated.

5. The diverter according to claim 4, said paper diverting member further comprising a portion extending perpendicularly from said flat plate and overlying said electromagnet, said portion of said paper diverting member having a first end joined to said flat plate and a second end in which a fitting hole is formed for joining said longitudinal shaft thereto.

6. An apparatus for switching a paper passage between alternate paths, comprising:

a combined document path;

a distributing roller on said combined document path;

a document discharge roller;

an original document path that leads from said distributing roller and through said document discharge roller;

a copy paper tray;

a copy paper path that leads from said distributing roller to said copy paper tray;

an electromagnetic sheet diverter positioned next to said distributing roller, said electromagnetic sheet diverter dividing said combined document path into said original document path and said copy paper path, said electromagnetic sheet diverter comprising:

a holding bracket mounted on said image forming apparatus;

an electromagnet mounted to said holding bracket;

a paper diverting member rotatably mounted to said apparatus and biased by a tension coil spring, said paper diverting member being attracted by and brought into contact with the electromagnet when said magnet is electrically activated;

a longitudinal shaft held by said paper diverting member and rotated along with said paper diverting member when said electromagnet is activated, said longitudinal shaft having a plurality of fitting grooves, said fitting grooves being spaced out at intervals along a length of said longitudinal shaft; and a plurality of passage switching members fixed to respective ones of the fitting grooves of the longitudinal shaft and rotated along with said longitudinal shaft, thereby switching the paper passage between said original document path and said copy paper path.

7. The apparatus according to claim 6, wherein said paper diverting member comprises a drive plate on one end thereof for cooperating with said electromagnet, said drive plate being connected to said tension coil spring, and wherein said paper diverting member has a fitting hole and a pin hole formed on another end thereof for holding said longitudinal shaft.

8. The apparatus according to claim 6, wherein each of said passage switching members comprises:

a flat surface formed on one end of said switching member;

a guide surface formed on a middle portion of said switching member; and a fixing part formed on another end of said switching member, said fixing part being provided with a fitting slit for being fitted over a corresponding one of said fitting grooves of said longitudinal shaft, said fitting slit having a configuration corresponding to a cross-section of said fitting groove.

9. The apparatus according to claim 6, wherein said holding bracket comprises a flat surface to which one end of said electromagnet is attached, said drive plate comprising a flat plate disposed at another end of said electromagnet and disposed parallel to said flat surface of said holding bracket when said electromagnet is activated.

10. The apparatus according to claim 9, said paper diverting member further comprising a portion extending perpendicularly from said flat plate and overlying said electromagnet, said portion of said paper diverting member having a first end joined to said flat plate and a second end in which a fitting hole is formed for joining said longitudinal shaft thereto.

11. An image forming apparatus for switching a paper passage between alternate paths, comprising:

a first input tray for holding document originals;

a second input tray for holding blank copy paper;

a combined document path;

a distributing roller on said combined document path;

a document discharge roller for discharging documents originating from said first input tray;

an original document path that leads from said distributing roller through said document discharge roller;

a copy paper tray for receiving documents processed by said image forming apparatus from said second input tray;

a copy paper path that leads from said distributing roller to said copy paper tray;

an electromagnetic sheet diverter positioned next to said distributing roller, said electromagnetic sheet diverter dividing said combined document path into said original document path and said copy paper path, said electromagnetic sheet diverter comprising:

a holding bracket mounted on said image forming apparatus;

an electromagnet mounted to said holding bracket;

a paper diverting member rotatably mounted to said apparatus and biased by a tension coil spring, said paper diverting member being attracted by and brought into contact with the electromagnet when said magnet is electrically activated;

a longitudinal shaft held by said paper diverting member and rotated along with said paper diverting member when said electromagnet is activated, said longitudinal shaft having a plurality of fitting grooves, said fitting grooves being spaced out at regular intervals along a length of said longitudinal shaft; and a plurality of passage switching members fixed to respective ones of the fitting grooves of the longitudinal shaft and rotated along with said longitudinal shaft, thereby switching the paper passage between said original document path and said copy paper path.

12. The apparatus according to claim 11, wherein said paper diverting member comprises a drive plate on one end thereof for cooperating with said electromagnet, said drive plate being connected to said tension coil spring, and wherein said paper diverting member has a fitting hole and a pin hole formed on another end thereof for holding said longitudinal shaft.

13. The apparatus according to claim 11, wherein each of said passage switching members comprises:

a flat surface formed on one end of said switching member;

a guide surface formed on a middle portion of said switching member; and a fixing part formed on another end of said switching member, said fixing part being provided with a fitting slit for being fitted over a corresponding one of said fitting grooves of said longitudinal shaft, said fitting slit having a configuration corresponding to a cross-section of said fitting groove.

14. The apparatus according to claim 11, wherein said holding bracket comprises a flat surface to which one end of said electromagnet is attached, said drive plate comprising a flat plate disposed at another end of said electromagnet and disposed parallel to said flat surface of said holding bracket when said electromagnet is activated.

15. The apparatus according to claim 14, said paper diverting member further comprising a portion extending perpendicularly from said flat plate and overlying said electromagnet, said portion of said paper diverting member having a first end joined to said flat plate and a second end in which a fitting hole is formed for joining said longitudinal shaft thereto.

16. An apparatus for switching a paper passage between alternate paths, comprising:

a combined document path;

a distributing roller on said combined document path;

a document discharge roller;

a first path that leads from said distributing roller and through said document discharge roller;

an output tray;

a second path that leads from said distributing roller to said output tray;

an electromagnetic sheet diverter positioned next to said distributing roller, said electromagnetic sheet diverter dividing said combined document path into said first path and said second path, said electromagnetic sheet diverter comprising:

a holding bracket mounted on said image forming apparatus;

an electromagnet mounted to said holding bracket;

a paper diverting member having a drive plate rotatably mounted to said apparatus and biased by a tension coil spring, said drive plate being attracted by and brought into contact with the electromagnet when said magnet is electrically activated;

a longitudinal shaft held by said paper diverting member, connected to said drive plate and rotated along with said paper diverting member when said electromagnet is activated, said longitudinal shaft having a plurality of fitting grooves, said fitting grooves being spaced out at intervals along a length of said longitudinal shaft; and a plurality of passage switching members fixed to respective ones of the fitting grooves of the longitudinal shaft and rotated along with said longitudinal shaft, thereby switching the paper passage between said first path and said second path.

17. The apparatus according to claim 16, wherein said paper diverting member comprises a drive plate on one end thereof for cooperating with said electromagnet, said drive plate being connected to said tension coil spring, and wherein said paper diverting member has a fitting hole and a pin hole formed in another end thereof for holding said longitudinal shaft.

18. The apparatus according to claim 16, wherein each of said passage switching members comprises:

a flat surface formed on one end of said switching member;

a guide surface formed on a middle portion of said switching member; and a fixing part formed on another end of said switching member, said fixing part being provided with a fitting slit for being fitted over a corresponding one of said fitting grooves of said longitudinal shaft, said fitting slit having a configuration corresponding to a cross-section of said fitting grooves.

19. The apparatus according to claim 16, further comprising a first input tray and a second input tray, wherein said document discharge roller discharges documents originating in said first input tray, and said output tray receives documents originating from said second input tray.

20. The apparatus according to claim 16, wherein said holding bracket comprises a flat surface to which one end of said electromagnet is attached, said drive plate comprising a flat plate disposed at another end of said electromagnet and disposed parallel to said flat surface of said holding bracket when said electromagnet is activated.

21. The apparatus according to claim 20, said paper diverting member further comprising a portion extending perpendicularly from said flat plate and overlying said electromagnet, said portion of said paper diverting member having a first end joined to said flat plate and a second end in which a fitting hole is formed for joining said longitudinal shaft thereto.

* * * * *